US010941637B2

(12) United States Patent
Skinner et al.

(10) Patent No.: US 10,941,637 B2
(45) Date of Patent: Mar. 9, 2021

(54) LASER FIRING HEAD FOR PERFORATING GUN

(71) Applicant: Halliburton Energy Services, Inc., Houston, TX (US)

(72) Inventors: Neal Gregory Skinner, Lewisville, TX (US); Etienne Samson, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 167 days.

(21) Appl. No.: 15/572,673

(22) PCT Filed: Jun. 26, 2015

(86) PCT No.: PCT/US2015/037957
§ 371 (c)(1),
(2) Date: Nov. 8, 2017

(87) PCT Pub. No.: WO2016/209259
PCT Pub. Date: Dec. 29, 2016

(65) Prior Publication Data

US 2018/0119530 A1 May 3, 2018

(51) Int. Cl.
*E21B 43/1185* (2006.01)
*F42B 3/113* (2006.01)
*F42C 13/02* (2006.01)

(52) U.S. Cl.
CPC ..... *E21B 43/1185* (2013.01); *F42B 3/113* (2013.01); *F42C 13/02* (2013.01)

(58) Field of Classification Search
CPC ..... E21B 43/1185; F42B 3/113; F42C 13/02
See application file for complete search history.

(56) References Cited

U.S. PATENT DOCUMENTS 4,870,902 A 10/1989 Simon et al.
5,322,019 A 6/1994 Hyland
(Continued)

FOREIGN PATENT DOCUMENTS

WO 2014/116425 A1 7/2014

OTHER PUBLICATIONS

International Search Report and Written Opinion issued in related PCT Application No. PCT/US2015/037957 dated Mar. 15, 2016, 15 pages.

(Continued)

*Primary Examiner* — David J Bagnell
*Assistant Examiner* — Yanick A Akaragwe
(74) *Attorney, Agent, or Firm* — John W. Wustenberg; Baker Botts L.L.P.

(57) ABSTRACT

In accordance with embodiments of the present disclosure, systems and methods for triggering detonation of a perforating gun via optical signals are provided. An improved laser firing head may be used with an optical cable (e.g., fiber optic cable) run through the wellbore to trigger detonation of a perforating gun in response to an optical signal. The laser firing head may be activated, and the perforating gun fired, upon the application of an optical signal output from the surface and transmitted through the optical cable. The disclosed system using the laser firing head with the optical cable may be impervious to electrical interference, since the laser firing head may only fire the perforating gun when a properly modulated laser or light source is directed down the optical cable for a specific period of time.

20 Claims, 4 Drawing Sheets

(56) References Cited

U.S. PATENT DOCUMENTS

| | | | | |
|---|---|---|---|---|
| 5,413,045 | A | 5/1995 | Miszewski | |
| 7,191,706 | B2 | 3/2007 | Chase et al. | |
| 10,047,592 | B2 * | 8/2018 | Burgos | E21B 43/11857 |
| 2005/0183607 | A1 | 8/2005 | Chase et al. | |
| 2006/0249045 | A1 | 11/2006 | Goodman et al. | |
| 2007/0044672 | A1 * | 3/2007 | Smith | E21B 23/00 102/201 |
| 2010/0025032 | A1 | 2/2010 | Smith et al. | |
| 2014/0203174 | A1 | 7/2014 | Skinner et al. | |
| 2015/0075783 | A1 * | 3/2015 | Angman | E21B 43/26 166/250.01 |
| 2015/0096752 | A1 | 4/2015 | Burgos et al. | |

OTHER PUBLICATIONS

International Preliminary Report on Patentability of related application PCT/US15/37957, dated Jan. 4, 2018, 12 pages.

* cited by examiner

LASER FIRING HEAD FOR PERFORATING GUN

CROSS-REFERENCE TO RELATED APPLICATION

The present application is a U.S. National Stage Application of International Application No. PCT/US2015/037957 filed Jun. 26, 2015, which is incorporated herein by reference in its entirety for all purposes.

TECHNICAL FIELD

The present disclosure relates generally to well drilling and hydrocarbon recovery operations and, more particularly, to a laser firing head for detonating a perforating device during hydrocarbon recovery operations.

BACKGROUND

Hydrocarbons, such as oil and gas, are commonly obtained from subterranean formations that may be located onshore or offshore. The development of subterranean formations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well and use a cement sheath around the outside of the casing to isolate the various formations penetrated by the well. To establish fluid communication between the hydrocarbon-bearing formations and the interior of the casing, the casing and cement sheath are perforated, typically using a perforating gun or similar apparatus.

Perforating guns typically establish communication between the formations and interior of the casing through the use of explosives, such as shaped charges, to create one or more openings through the casing. Perforating guns are generally detonated downhole upon receiving an electrical signal transmitted from the surface. It is desirable to trigger a detonator to fire one or more perforating guns only once the perforating guns are disposed at certain predetermined positions within the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
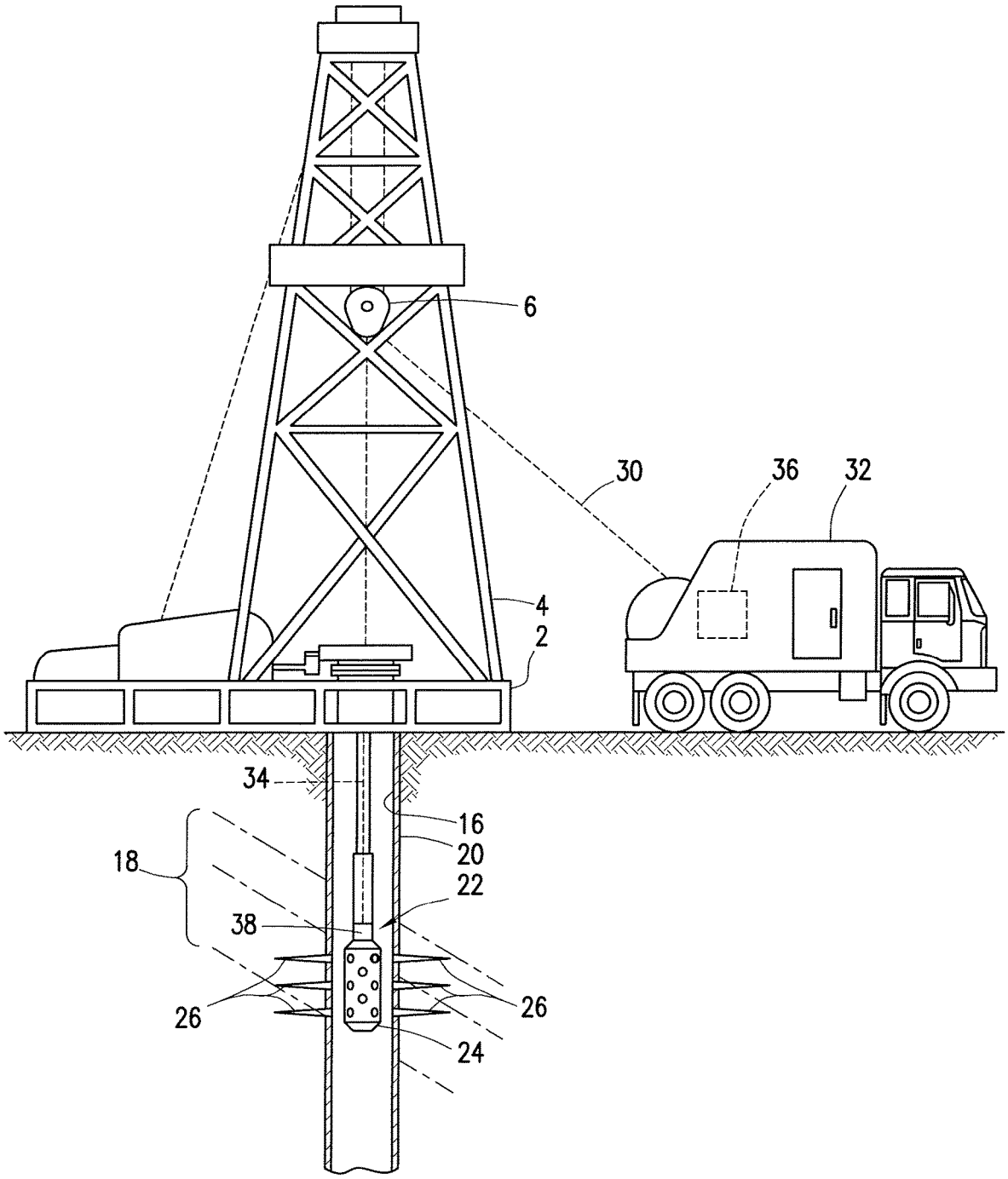
FIG. 1 is schematic partial cross-sectional view showing a perforating system deployed in a wellbore environment, in accordance with an embodiment of the present disclosure.

Illustrative embodiments of the present disclosure are described in detail herein. In the interest of clarity, not all features of an actual implementation are described in this specification. It will, of course, be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for triggering detonation of a perforating gun via optical signals. The disclosed techniques may be used to enhance the effectiveness and accuracy of wellbore perforating operations by substantially reducing the probability of firing perforating guns on the surface or at an undesired position within the wellbore.

Currently existing perforating guns typically are fired in response to an electrical signal sent downhole to a detonator device. Electrically fired perforating guns can be set off at undesired times, due to electrical interference, among other things. To overcome these drawbacks, present embodiments are directed to an improved laser firing head that may be used with an optical cable (e.g., fiber optic cable) run through the wellbore to trigger detonation of a perforating gun in response to an optical signal. The laser firing head may be activated, and the perforating gun fired, upon the application of an optical signal output from the surface and transmitted through the optical cable. The disclosed system using the laser firing head with the optical cable may be impervious to electrical interference, since the laser firing head may only fire the perforating gun when a properly configured laser or light source is directed down the optical cable for a specific period of time.

The disclosed laser firing head may be easily adapted for use with existing perforating guns and their associated detonators. To that end, the laser firing head may include an optoelectronic circuit designed to dump a large amount of stored energy from a capacitor into a detonator to fire the perforating gun, in response to receiving a desired optical signal.

Other features may be used to improve the accuracy and effectiveness of detonating the perforating gun via the disclosed laser firing head. For example, the laser firing head may incorporate various filters to ensure that the detonator is triggered only upon receiving a specific modulated optical signal at the laser firing head. The disclosed systems and methods may be readily adapted to enable sequential firing of multiple laser firing heads and perforating guns via optical signals communicated over a single optical cable. The disclosed laser firing head may facilitate higher effectiveness and accuracy of perforating gun detonation than is currently available using electrically triggered systems. In addition, the laser firing head may be relatively simple and inexpensive to manufacture, since it can be constructed from commercially available components. Further, the laser firing head may be compatible with currently existing electric line detonators and perforating guns, enabling retrofitting of the optically triggered laser firing head to existing perforating systems.

Turning now to the drawings, FIG. 1 illustrates oil well equipment being used in an illustrative drilling environment. A drilling platform 2 supports a derrick 4 having a traveling block 6 for raising and lowering a drill string (not shown). The drill string creates a wellbore 16 that passes through various formations 18. At various times during the drilling process, the drill string may be removed from the wellbore 16. As illustrated, the wellbore 16 may be lined with casing 20, which is cemented in place within the wellbore 16.

After the drill string has been removed and the wellbore 16 cased, as shown, perforating operations may be performed in the wellbore 16. To that end, a perforating system 22 may be lowered into and positioned within the wellbore 16. One or more perforating guns 24 in the perforating system 22 may be positioned opposite predetermined locations for forming perforations 26 through the casing 20, the cement (not shown), and outward into the subsurface formation 18 surrounding the wellbore 16.

As illustrated, the perforating system 22 may be a wireline perforating system that is lowered into the wellbore 16, for example, on a wireline 30 being unspooled from a wireline truck 32. In other embodiments, however, the perforating system 22 may be lowered into the wellbore via a tubular string (such as a work string, a production tubing string, an injection string, etc.), a slickline, or coiled tubing. In still other embodiments, the perforating system 22 may be flowed into the wellbore 16 via a surface pump, or gravitational attraction.

In the presently disclosed system, the wireline 30 or other conveying apparatus (e.g., tubular string, slickline, tubing, etc.) may feature an optical cable 34 for communicating triggering commands to fire the perforating gun 24. The optical cable 34 may include one or more optical fibers that are communicatively coupled between an optical source 36 and a laser firing head 38 disposed downhole. As illustrated, the optical source 36 may be a laser or light source positioned at the surface of the wellbore 16. In some embodiments, the optical source 36 may be used to output a modulated optical signal through the optical cable 34.

The laser firing head 38 is used to initiate firing or detonation of the perforating guns 24 in response to an optical signal received via the optical cable 34 when it is desired to form the perforations 26. In addition, the laser firing head 38 may be used to convert the optical signals received from the optical cable 34 into electrical energy for powering a detonator used to fire the perforating gun 24. Although the laser firing head 38 is depicted in FIG. 1 as being connected above the perforating gun 24, one or more laser firing heads 38 may be interconnected in the perforating system 22 at any location, with the location(s) preferably being connected to one or more perforating guns 24 by a detonation train.

The optically activated laser firing head 38 may enable more effective and accurate control of the detonation process for firing one or more perforating guns 24. Since the laser firing head 38 responds only to specific optical signals received from the optical cable 34, the system may be less prone to accidental detonation before the perforator gun 24 is positioned in a desired location downhole. Indeed, since the laser firing head 38 is optically powered, no external electrical power is required to detonate the perforating system 22. Accordingly, the perforating system 22 may be immune to electromagnetic interference or radio frequency interference that might otherwise disturb an electrically powered firing head.

Although not shown, in embodiments where the perforating system 22 is lowered via a tubular string, the perforating system 22 may be positioned, sealed, and secured in the casing 20 by a packer. Such a packer would seal off an annulus formed radially between the tubular string and the wellbore 16. In tubular string conveyed perforating systems, the disclosed optical cable 34 may be run along the pipe or other tubular members leading to the laser firing head 38.

In some embodiments, the optical cable 34 may also be used to perform additional operations downhole. For example, the optical cable 34 may be used to provide fiber optic sensing of various downhole parameters (e.g., temperature, pressure, vibration, etc.), telemetry for certain downhole components, and control signals for operating other components within the downhole system.

It should be noted that the system of FIG. 1 is merely one example of an unlimited variety of different well systems which can embody principles of this disclosure. Thus, the scope of this disclosure is not limited at all to the details of the well system, its associated methods, the perforating system 22, etc. described herein or depicted in the drawings. For example, it is not necessary for the wellbore 16 to be vertical, for there to be a single perforating gun 24, or for the firing head 38 to be positioned above the perforating gun 24, etc. Instead, the well system configuration of FIG. 1 is intended merely to illustrate how the principles of this disclosure may be applied to an example perforating system 22, in order to provide an effectively controlled detonation of the perforating gun 24. These principles can be applied to many other examples of well systems and perforating systems, while remaining within the scope of this disclosure.

Figure 2:
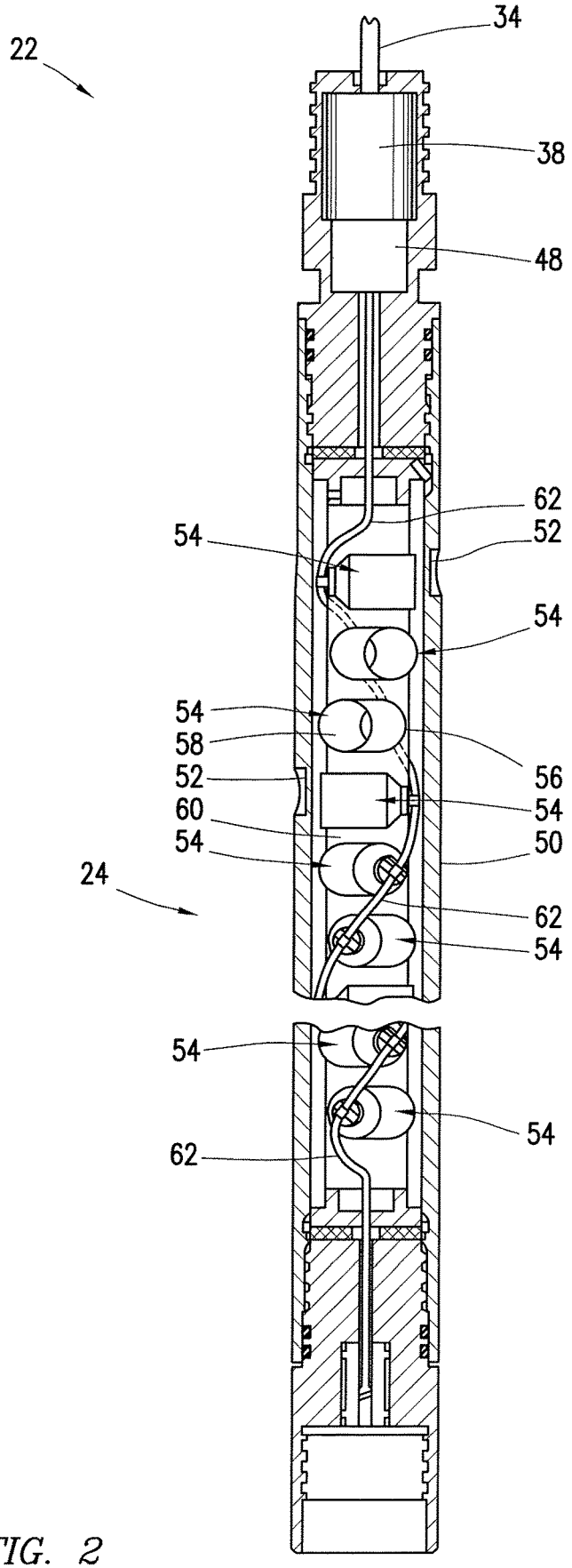
FIG. 2 is a schematic cutaway view showing the perforating system of FIG. 1, in accordance with an embodiment of the present disclosure.

Having now discussed the general layout of the perforating system 22 used during well completions, a more detailed description of certain components of the perforating system 22 will be provided. To that end, FIG. 2 depicts one possible assembly of the components of the perforating system 22 that may be used downhole. The perforating system 22 may include the perforating gun 24, the laser firing head 38, and a detonator 48, among other things.

The perforating gun 24 may include a carrier gun body 50 made of a cylindrical sleeve having a plurality of radially reduced areas depicted as scallops or recesses 52. Radially aligned with each of the recesses 52 is a respective one of a plurality of shaped charges 54, as visible in FIG. 2. Each of the shaped charges 54 may include a charge case 56 and a liner 58. Disposed between each charge case 56 and liner 58 is a quantity of high explosive.

The shaped charges 54 are retained within the carrier gun body 50 by a charge holder 60, which in some embodiments includes an outer charge holder body and an inner charge holder body. Although not shown, in such configurations, the outer tube supports the discharge ends of the shaped charges 54, while the inner tube supports the initiation ends of the shaped charges 54. Disposed within or around the charge holder 60 is a detonator cord 62, such as Primacord®, which is used to detonate the shaped charges 54. Any number of arrangements of the shaped charges 54, charge holder 60, and detonator cord 62 may be utilized in embodiments of the perforating gun 24 in accordance with the present disclosure.

The perforating system 22 may also include the detonator 48 used to fire the various shaped charges 54 of the perforating gun 24. As illustrated, the detonator cord 62 may extend from the detonator 48 toward the back of each shaped charge 54 within the perforating gun 24. The detonator cord 62 may be used to communicate a detonation (i.e., shock wave) through the perforating gun 24 to fire all of the shaped charges 54 once the detonator 48 is triggered by the laser firing head 38.

The detonator 48 may be any desired type of detonator including, for example, a RED® (Rig Environment Detonator), a product of JET RESEARCH CENTER®, designed for use in downhole operations. The detonator 48 may be an electro-explosive device designed to send a shock wave down the detonator cord 62 in response to an element in the detonator 48 heating up very quickly. This heat can be generated through a semiconductor bridge element, a bridgewire element, an exploding foil element, or some other element into which a certain amount of electrical energy is driven over a short period of time. In response to a desired optical signal transmitted through the optical cable 34, the laser firing head 38 may supply the electrical energy to the detonator 48 for firing the perforating gun 24 as described herein. It should be noted that other types of detonators 48 may be used in other embodiments of the perforating system 22.

In the illustrated embodiment, the laser firing head 38 and the detonator 48 may be disposed at an upper portion of the perforating system 22 and coupled to the perforating gun 24. In this way, the laser firing head 38 may be shielded from the exploding shaped charges 54 at the lower portion of the perforating gun 24. The explosive operation of the perforating gun 24 may consume or damage certain parts of the perforating system 22. In some embodiments, the firing head 38 may be packaged relatively separately (and a certain distance from) the perforating gun 24 and the detonator 48. This may enable the firing head 38 to be used to activate the detonator 48 (thereby firing the illustrated perforating gun 24), selectively removed from the perforating system 22, and then reused in a different perforating system to activate another detonator for firing another perforating gun.

FIG. 3 is a schematic illustration of one embodiment of the presently disclosed laser firing head 38 that may be used to activate the detonator 48 in response to a specific optical signal 88 received through the optical cable 34. As illustrated, the laser firing head 38 includes an optoelectronic circuit 90 coupled to the detonator 48 for activating the detonator 48 in response to the optical signal 88.

In the illustrated embodiment, the optoelectronic circuit 90 may include at least a photodiode 92, a voltage multiplier 94, a capacitor 96, and a switch 98. As shown, the optoelectronic circuit 90 may also include a resistor 100 coupled between the photodiode 92 and the voltage multiplier 94. It should be noted that other embodiments of the laser firing head 38 may include different components or combinations of components within the optoelectronic circuit 90.

The illustrated photodiode 92 may represent a single photodiode or an array of photodiodes. The one or more photodiodes 92 may be illuminated via the optical signal 88, which is generated at an optical source (e.g., light source positioned at the surface of the well) and carried through the optical cable 34 to the laser firing head 38. As mentioned above, the light source may generate a modulated optical signal 88, and the one or more photodiodes 92 may generate a modulated voltage across the resistor 100 based on the received modulated optical signal 88.

The voltage multiplier 94 may be used to increase a portion of the voltage output from the photodiode(s) 92. The voltage multiplier 94 may receive an AC portion of the voltage across the resistor 100, increase the AC voltage, and convert the stepped up AC voltage to a DC voltage output toward the capacitor 96. This increased DC voltage may charge the capacitor 96 such that a certain amount of electrical energy is built up and stored across the capacitor 96 over time.

The voltage multiplier 94 may be a relatively simple device, generally constructed from off-shelf parts. In some embodiments, the voltage multiplier 94 may include a series of diodes and capacitors that increase the input AC voltage in several stages. In other embodiments, the voltage multiplier 94 may include several stages of transformers coupled to an output rectifying diode or full wave bridge for delivering the increased DC voltage to the capacitor 96. In still other embodiments, the voltage multiplier 94 may be a combination of these two types, having one or more diodes, capacitors, and transformers operating together to increase the AC voltage therethrough and convert the increased AC voltage to DC. Any other desirable combinations of passive electronic components (e.g., capacitors, diodes, transformers, etc.) may be used to form the voltage multiplier 94 for increasing the voltage stored across the capacitor 96.

Once the voltage across the capacitor 96 reaches a threshold value, the switch 98 may be activated to dump the stored energy from the capacitor 96 into the detonator 48. For example, in the illustrated embodiment, the switch 98 may include a spark gap designed to break down when the voltage across the capacitor 96 reaches the predetermined threshold. For example, the switch 98 may include a gas discharge tube (GDT) designed to electrically break down when the capacitor 96 (e.g., 6 μF capacitor) is electrically charged to approximately 150 Volts DC. Upon this breakdown of the GDT, the energy stored in the capacitor 96 may be suddenly dumped into the detonator 48. This amount of energy supplied from the capacitor 96 into the detonator 48 in a relatively short time period may activate the detonator 48, as described above, thereby causing the perforating gun to fire.

In some embodiments, the amount of energy supplied from the capacitor 96 to the detonator 48 may be equal to or on the order of approximately 0.07 Joules, which is stored in the capacitor 96 prior to firing the perforating gun. This is a relatively small amount of stored energy, which can be readily delivered to the laser firing head 38 via optical energy.

The disclosed system may gradually build up the desired voltage of electrical energy stored in the capacitor 96 via the conversion of optical signals into DC voltage at the laser firing head 38. Since the power available through optical signals is relatively lower than those from electrical signals, this process of building up the desired amount of stored energy may take a certain amount of time prior to firing the perforating gun. Thus, the optical power transmitted through the optical cable 34 may need to be present for a minimum amount of time (e.g., a few seconds or minutes) prior to the laser firing head 38 activating the detonator 48. Lower available optical power for generating the optical signal and lower efficiencies of the photodiodes 92 and the firing capacitor 96 may increase the time required to charge the capacitor 96. The longer amount of time for charging the capacitor 96 and ultimately firing the perforating gun may reduce the likelihood of the system being accidentally set off, since the optical source at the surface may need to be on for a predetermined amount of time prior to the system firing.

Some embodiments of the laser firing head 38 are designed to use only modulated optical power from the optical cable 34 to activate the detonator 48 for firing the perforating gun. For example, the voltage multiplier 94 may be configured to receive and increase only an AC voltage from the photodiode 92. Thus, if the photodiode 92 of the laser firing head 38, or the optical cable 34, is exposed to a strong and constant light source (e.g., natural or artificial light), the photodiode 92 would generate a DC signal, which cannot be increased by the voltage multiplier to charge the capacitor 96. As a result, any DC voltage supplied to the voltage multiplier (e.g., due to a light source shining onto the cable 34) will not enable the laser firing head 38 to activate the detonator 48. The laser firing head 38, therefore, may be unable to fire the perforating gun unless the desired modulated optical signal 88 is provided to the optical cable 34.

In other embodiments, the laser firing head 38 may be designed to respond to optical signals that are not modulated. That is, the laser firing head 38 may transfer continuous wave optical power from the optical cable 34 into an increased voltage for charging the capacitor 96. To that end, the laser firing head 38 may include a DC/AC converter disposed between the photodiode 92 and the voltage multiplier 94. This DC/AC converter may receive a DC voltage from the photodiode 92 measuring the constant, unmodulated optical signal and output an AC voltage component of the signal to the voltage multiplier 94. The voltage multiplier 94 may then step up the AC voltage and convert the AC voltage to an increased DC voltage for charging the capacitor 96. This may enable firing the perforating gun using a constant optical power source coupled to the optical cable 34.

It should be noted that the laser firing head 38 may be compatible for use with existing perforating gun systems and detonators 48. In some instances, the laser firing head 38 may be provided in a kit to retrofit an existing electrically fired perforating system, so that the system may be fired in response to optical signals instead of electrical signals from the surface.

The laser firing head 38 may be constructed to operate without using any consumable components (e.g., batteries) housed in the laser firing head 38. Although the detonator 48 may be consumable, the components that make up the optoelectronic circuit 90 may be reusable. As such, the illustrated laser firing head 38 may be reusable with different detonators to fire different perforating guns. The laser firing head 38 may be packaged to avoid damage due to shock from the perforating gun firing so that the laser firing head 38 may be used multiple times.

Figure 3A:
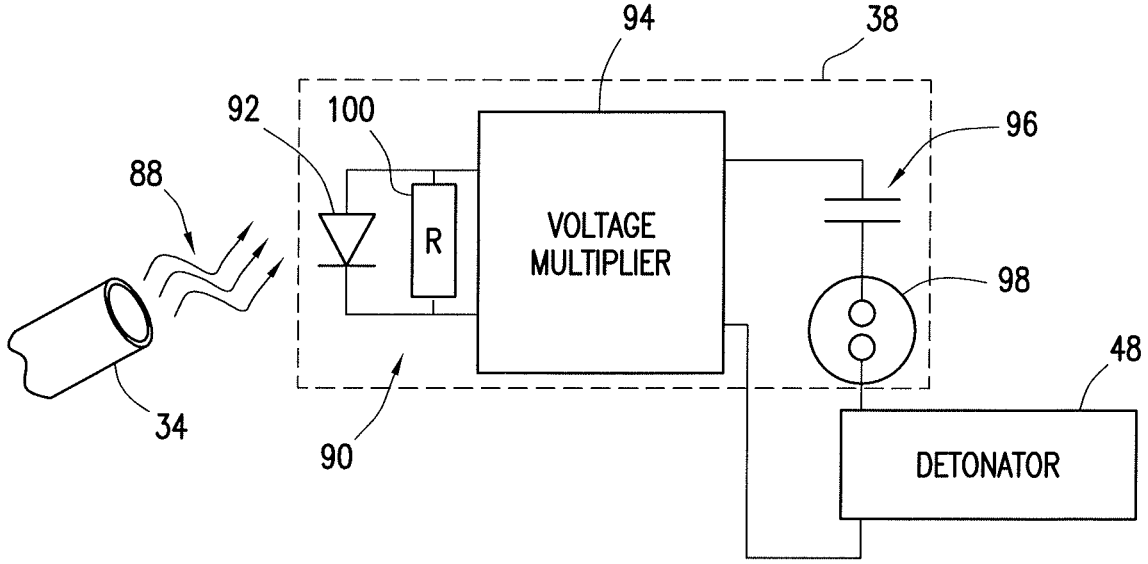
FIGS. 3A-3C are schematic diagrams illustrating different embodiments of a laser firing head that may be used in the perforating system of FIGS. 1 and 2, in accordance with an embodiment of the present disclosure.
Figure 3B:
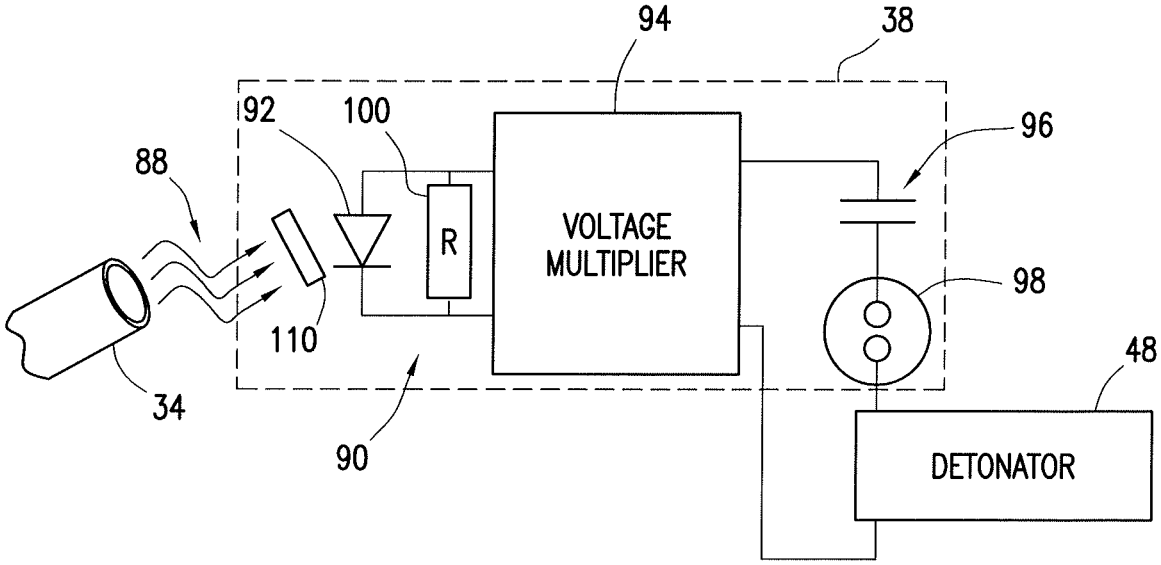

As shown in FIG. 3B, the laser firing head 38 may optionally include an optical filter 110 (i.e., optical band-pass filter) positioned between the illuminating fiber of the optical cable 34 and the one or more photodiodes 92. The optical filter 110 may effectively limit the range of optical wavelengths that can be used to fire the perforating gun. That is, the filter 110 may only let the optical signal 88 through to the photodiode 92 if the signal 88 is transmitted through the optical cable 34 at an optical wavelength within a predetermined range of wavelengths. Ultimately, the optical filter 110 may limit the range of optical wavelengths that can reach the optoelectronic circuit 90 to trigger the detonator 48. Thus, the optical filter 110 may add another layer of protection against accidental detonation to the triggering system.

It should be noted that the laser firing head 38 of FIG. 3A, for example, may be configured to perform similar filtering of optical signals based on optical wavelength, but without the use of a separate optical filter (e.g., 110). In such embodiments, the internal bandgap of the semiconductor making up one or more of the photodiodes 92 may act as an optical filter. This is because each semiconductor type may have its own semiconductor bandgap, which is the energy required to kick an electron from the valance band to the conduction band. The photons in light contain energy that is inversely proportional to the optical wavelength of the light (e.g., short wavelength light is more energetic than longer wavelength light). If the optical wavelength of the received optical signal 88 is not short enough to kick the electrons in the photodiode 92 to the conduction band, then the optical signal may not fire the photodiode 92. Thus, the photodiode 92, or group of photodiodes 92, may include its own internal quantum filter to enable firing of the perforating gun only when the optical signal 88 is within a desired range of optical wavelengths. For example, a 1300 nanometer photodiode may generate an electrical current upon detection of incident light at 1300 nanometers and 850 nanometers, but not for incident light at 1550 nanometers.

Figure 3C:
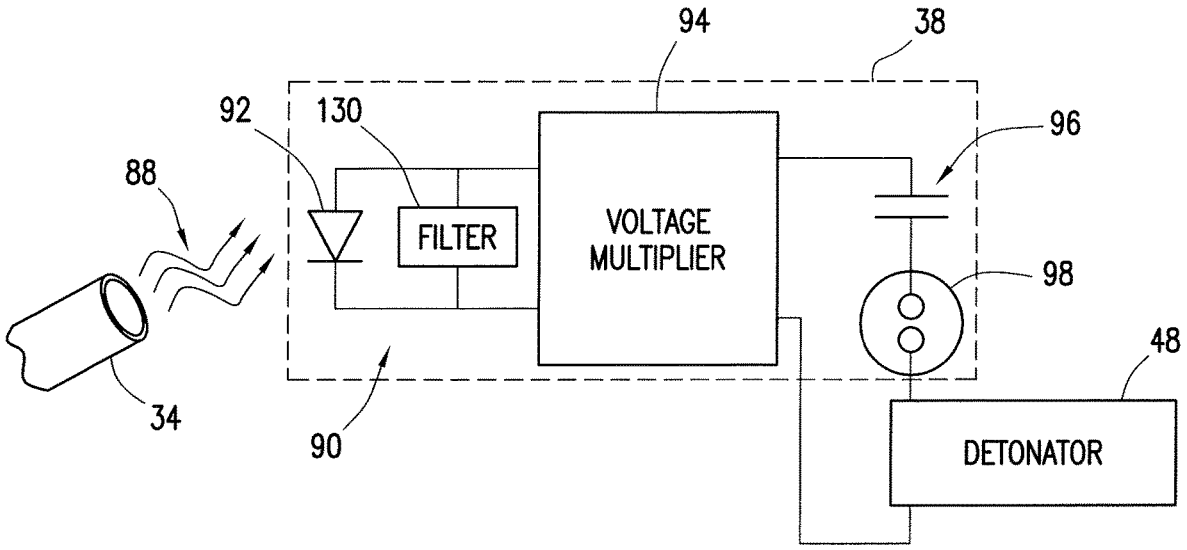

FIG. 3C shows an embodiment of the laser firing head 38 that may include an electronic filter 130 in place of the resistor 100 of FIG. 3A. The electronic filter 130 may include any desirable type of filter used to limit the range of frequencies of the AC voltage output from the photodiode 92 that reaches the voltage multiplier 94. For example, the electronic filter 130 may be a LC band-pass filter for limiting the AC voltage frequencies to a relatively narrow range. In other embodiments, the electronic filter 130 may be either a RC filter or a RL filter configured for use as a high pass or low pass filter to limit the AC voltage frequencies. Any desired combination of these filters may be used to form the electronic filter 130. Ultimately, the electronic filter 130 may limit the range of modulation frequencies of the modulated optical signal 88 that can trigger the detonator 48 and fire the perforating gun. Thus, the electronic filter 130 may add another layer of protection against accidental detonation to the triggering system.

It should be noted that some embodiments of the laser firing head 38 may include both the disclosed optical filter 110 of FIG. 3B and the disclosed electronic filter 130 of FIG. 3C. Such laser firing heads 38 may be configured to activate the detonator 48 only when the optical signal 88 received from the optical cable 34 is within a desired optical wavelength range and is modulated within a desired modulation frequency range.

Figure 4:
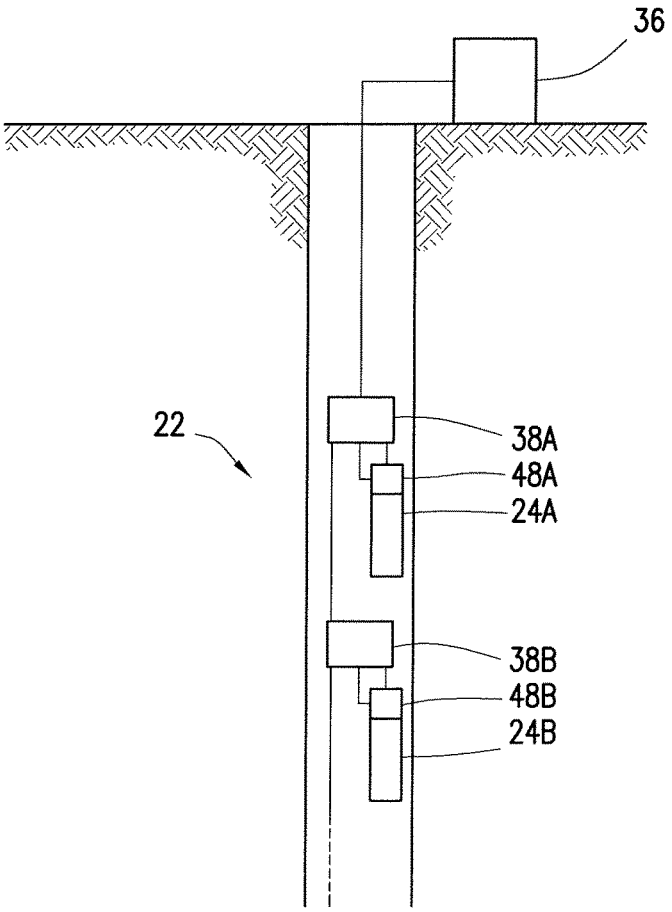
FIG. 4 is a schematic diagram illustrating a plurality of laser firing heads disposed along a single optical cable used to trigger detonation of a plurality of perforating guns, in accordance with an embodiment of the present disclosure.

Multiple laser firing heads 38 having the above-described filters in place may be used together to selectively fire different perforating guns via optical signals transmitted through a single optical fiber in the optical cable 34. FIG. 4 is a schematic representation of a perforating system 22 having two perforating guns 24A and 24B with two associated detonators 48A and 48B and two associated laser firing heads 38A and 38B. It should be noted that other embodiments of the disclosed perforating system 22 may have a greater number of perforating guns 24, detonators 48, and laser firing heads 38.

Each of the laser firing heads 38A and 38B may be communicatively coupled to a single optical cable 34 that acts as a waveguide for signals from the optical source 36. It may be desirable to selectively fire the perforating guns 24A and 24B at different times. In currently used systems that trigger perforating guns via electrical signals, the perforating system generally includes switches to trigger firing of additional perforating guns. That is, when one perforating gun fires, this generally sets a switch so that another gun can go off. Typically, these perforating guns are fired all at once.

In presently disclosed embodiments, the laser firing heads 38 may allow for selective triggering of different perforating guns 24 located throughout a single perforating system 22.

At least two methods may be used to multiplex the laser firing heads 38 so that the multiple laser firing heads 38 can be activated by the same optical cable 34.

First, the laser firing heads 38 may be selectively activated by transmitting different wavelengths of optical signals through the optical cable 34. One or more of the laser firing heads 38A and 38B may be equipped with optical band-pass filters (e.g., 110 of FIG. 3B) to selectively trigger the laser firing head 38 when the optical signal has a desired optical wavelength. The laser firing heads 38A and 38B may feature optical filters that do not have overlapping wavelength ranges, so that only one of the laser firing heads 38 may be used to trigger the corresponding detonator 48 and perforating gun 24 at a time.

In addition to or in lieu of optical wavelength multiplexing, the laser firing heads 38 may be selectively activated by modulating the optical signals at different frequencies through the optical cable 34. One or more of the laser firing heads 38A and 38B may be equipped with electronic filters (e.g., 130 of FIG. 3C) to selectively trigger the laser firing head 38 when the optical signal is modulated at a desired frequency. The laser firing heads 38A and 38B may feature electronic filters that do not have overlapping frequency ranges, so that only one of the laser firing heads 38 may be used to trigger the corresponding detonator 48 and perforating gun 24 at a time.

Embodiments disclosed herein include:

A. A system including a perforating gun for perforating a subterranean formation, a detonator for firing the perforating gun, an optical source for outputting an optical signal, an optical cable communicatively coupled to the optical source for transmitting the optical signal output from the optical source, and a laser firing head. The laser firing head includes an optoelectronic circuit for receiving the optical signal from the optical cable and triggering the detonator to fire the perforating gun in response to the optical signal being received at the laser firing head for a predetermined amount of time.

B. A laser firing head for triggering a detonator to fire a perforating gun. The laser firing head includes a photodiode for detecting an optical signal from an optical cable coupled to the laser firing head and outputting a voltage in response to the detected optical signal. The laser firing head also includes a voltage multiplier coupled to the photodiode for receiving at least a portion of the voltage output from the photodiode and outputting an increased DC voltage to charge a capacitor. The laser firing head further includes a switch coupled to the capacitor for supplying electrical energy from the capacitor to the detonator for firing the perforating gun when the charge across the capacitor reaches a threshold.

C. A method including outputting an optical signal from an optical source through an optical cable extending into a wellbore and illuminating a photodiode of a laser firing head coupled to a perforating gun disposed in the wellbore via the optical signal transmitted through the optical cable. The method also includes increasing a voltage output from the photodiode via a voltage multiplier of the laser firing head to charge a capacitor disposed in the laser firing head, supplying stored electrical energy from the capacitor to a detonator when the charge across the capacitor reaches a threshold, and firing the perforating gun via the detonator in response to the detonator receiving the stored electrical energy from the capacitor.

Each of the embodiments A, B, and C may have one or more of the following additional elements in combination. Element 1: wherein the optical signal is a modulated optical signal. Element 2: wherein the optical signal is a continuous wave optical signal. Element 3: wherein the optoelectronic circuit in the laser firing head includes: a photodiode for detecting the optical signal from the optical cable and outputting an AC voltage in response to the detected optical signal; a voltage multiplier coupled to the photodiode for receiving the AC voltage output from the photodiode and outputting an increased DC voltage to charge a capacitor; and a switch coupled to the capacitor for supplying electrical energy from the capacitor to the detonator for firing the perforating gun when the charge across the capacitor reaches a threshold. Element 4: further including a wireline tool disposed along a wireline, wherein the wireline tool includes the laser firing head and the perforating gun, and wherein the wireline includes the optical cable. Element 5: further including a tubular string coupled to the perforating gun for lowering the perforating gun and the laser firing head to a specified depth of a wellbore. Element 6: further including a plurality of perforating guns and a plurality of associated laser firing heads disposed at different points along the optical cable for selectively actuating one or more of the plurality of perforating guns based on the optical signal transmitted through the optical cable. Element 7: wherein each of the plurality of laser firing heads includes an optical filter disposed between the optical cable and the corresponding optoelectronic circuit for limiting a range of optical wavelengths of the optical signal that reach the optoelectronic circuit. Element 8: wherein each of the plurality of laser firing heads includes an electronic filter disposed in the optoelectronic circuit for limiting a range of modulation frequencies of the optical signal that triggers the corresponding detonator to fire the corresponding perforating gun. Element 9: wherein the perforating gun is a consumable component and wherein the laser firing head is removable from the perforating gun to be used with a different perforating gun.

Element 10: wherein the laser firing head does not include a power supply. Element 11: wherein the laser firing head is selectively removable from the perforating gun and reusable with different perforating guns. Element 12: further including a DC/AC converter disposed between the photodiode and the voltage multiplier to convert a DC voltage output from the photodiode to AC voltage for supplying the voltage multiplier. Element 13: further including an optical filter disposed between the optical cable and the photodiode to limit a range of optical wavelengths of the optical signal that reach the photodiode. Element 14: further including an electronic filter disposed between the photodiode and the voltage multiplier to limit a range of modulation frequencies of a modulated optical signal that reach the voltage multiplier.

Element 15: further including filtering the optical signal so that a limited range of optical wavelengths illuminate the photodiode. Element 16: further including filtering the voltage output from the photodiode so that a limited range of modulation frequencies of the voltage reach the voltage multiplier. Element 17: further including: outputting a first optical signal from the optical source through the optical cable; triggering a first detonator to fire a first perforating gun via a first laser firing head disposed along the optical cable in response to the first optical signal being transmitted through the optical cable for a predetermined time period; outputting a second optical signal from the optical source through the optical cable; and triggering a second detonator to fire a second perforating gun via a second laser firing head disposed along the optical cable in response to the second optical signal being transmitted through the optical cable for a predetermined time period. Element 18: further including: removing the laser firing head from the perforating gun after firing the perforating gun; and reusing the laser firing head to trigger detonation of a different perforating gun.

Although the present disclosure and its advantages have been described in detail, it should be understood that various changes, substitutions and alterations can be made herein without departing from the spirit and scope of the disclosure as defined by the claims.

What is claimed is:

1. A system, comprising:

a plurality of perforating guns for perforating a subterranean formation;

a plurality of detonators each for firing a corresponding one of the perforating guns;

an optical source;

an optical cable communicatively coupled to the optical source; and a plurality of laser firing heads each disposed at different locations along a length of the optical cable, wherein each of the plurality of laser firing heads is communicatively coupled to and physically detached from one of the plurality of detonators and is disposed uphole to the one of the plurality of detonators at a distance, wherein each of the plurality of laser firing heads comprises:

an optoelectronic circuit for receiving an optical signal transmitted from the optical source via the optical cable and triggering a corresponding one of the detonators to fire the corresponding perforating gun in response to the optical signal being received at the laser firing head for a predetermined amount of time, wherein the optoelectronic circuit in each of the laser firing heads comprises:

a DC/AC converter configured to convert a DC voltage output to an AC voltage component;

wherein the plurality of laser firing heads selectively actuate one or more of the plurality of perforating guns in response to a voltage based actuating signal transmitted through the optical cable.

2. The system of claim 1, wherein the optical signal is a modulated optical signal.

3. The system of claim 1, wherein the optical signal is a continuous wave optical signal.

4. The system of claim 1, wherein the optoelectronic circuit in each of the laser firing heads comprises:

a photodiode for detecting the optical signal from the optical cable and outputting an AC voltage in response to the detected optical signal;

a voltage multiplier coupled to the photodiode for receiving the AC voltage output from the photodiode and outputting an increased DC voltage to charge a capacitor; and a switch coupled to the capacitor for supplying electrical energy from the capacitor to the detonator for firing the perforating gun when the charge across the capacitor reaches a threshold.

5. The system of claim 1, further comprising a wireline tool disposed along a wireline, wherein the wireline tool comprises the plurality of laser firing heads and the plurality of perforating guns, and wherein the wireline comprises the optical cable.

6. The system of claim 1, further comprising a tubular string coupled to the plurality of perforating guns for lowering the perforating guns and the plurality of laser firing heads to a specified depth of a wellbore.

7. The system of claim 1, wherein the plurality of perforating guns and the plurality of associated laser firing heads are disposed at different points along the optical cable.

8. The system of claim 1, wherein each of the plurality of laser firing heads comprises an optical filter disposed between the optical cable and the corresponding optoelectronic circuit for limiting a range of optical wavelengths of the optical signal that reach the optoelectronic circuit.

9. The system of claim 1, wherein each of the plurality of laser firing heads comprises an electronic filter disposed in the optoelectronic circuit for limiting a range of modulation frequencies of the optical signal that triggers the corresponding detonator to fire the corresponding perforating gun.

10. The system of claim 1, wherein each of the plurality of perforating guns is a consumable component and wherein the corresponding laser firing head is removable from the perforating gun to be used with a different perforating gun.

11. The system of claim 1, wherein the plurality of perforating guns are detached from each other and spaced from each other along the length of the optical cable, wherein each of the plurality of detonators is coupled to one of the plurality of perforating guns at an upper portion of the plurality of perforating guns.

12. A laser firing head for triggering a detonator to fire a perforating gun, the laser firing head comprising:

a photodiode for detecting an optical signal from an optical cable coupled to the laser firing head and outputting a voltage in response to the detected optical signal;

a voltage multiplier coupled to the photodiode for receiving at least a portion of the voltage output from the photodiode and outputting an increased DC voltage to charge a capacitor;

a DC/AC converter disposed between the photodiode and the voltage multiplier to convert a DC voltage output from the photodiode to AC voltage for supplying the voltage multiplier; and a switch coupled to the capacitor for supplying electrical energy from the capacitor to the detonator for firing the perforating gun when the charge across the capacitor reaches a threshold.

13. The system of claim 12, wherein the laser firing head is selectively removable from the perforating gun and reusable with different perforating guns.

14. The system of claim 12, further comprising an optical filter disposed between the optical cable and the photodiode to limit a range of optical wavelengths of the optical signal that reach the photodiode.

15. A method, comprising:

outputting a first optical signal from an optical source through an optical cable extending into a wellbore;

illuminating a photodiode of a first laser firing head coupled to a first perforating gun disposed in the wellbore via the first optical signal transmitted through the optical cable, the first laser firing head disposed at a first location along a length of the optical cable;

outputting an AC voltage component of a DC voltage output from the photodiode with a DC/AC converter;

increasing the AC voltage component via a voltage multiplier of the first laser firing head to charge a capacitor disposed in the first laser firing head;

supplying stored electrical energy from the capacitor to a first detonator when the charge across the capacitor reaches a threshold, wherein the first laser firing head is communicatively coupled to and physically detached from the first detonator and disposed uphole to the first detonator at a distance;

firing the first perforating gun via the first detonator in response to the first detonator receiving the stored electrical energy from the capacitor;

outputting a second optical signal from the optical source through the optical cable; and triggering a second detonator to fire a second perforating gun via a second laser firing head disposed at a second location along the length of the optical cable in response to the second optical signal being transmitted through the optical cable, wherein the second laser firing head is communicatively coupled to and physically detached from the second detonator and disposed uphole to the second detonator at a distance;

wherein the first and second optical signals are each voltage based actuating signals transmitted through the optical cable to selectively trigger the first and second detonators, respectively.

16. The method of claim 15, further comprising filtering the first optical signal so that a limited range of optical wavelengths illuminate the photodiode.

17. The method of claim 15, further comprising filtering the DC voltage output from the photodiode so that a limited range of modulation frequencies of the voltage reach the voltage multiplier.

18. The method of claim 15, further comprising triggering the first detonator in response to the first optical signal being transmitted through the optical cable for a predetermined time period; and triggering the second detonator in response to the second optical signal being transmitted through the optical cable for a predetermined time period.

19. The method of claim 15, further comprising:

removing the first laser firing head from the first perforating gun after firing the first perforating gun; and reusing the first laser firing head to trigger detonation of a different perforating gun.

20. The method of claim 15, wherein the first perforating gun is detached from and spaced from the second perforating gun along the length of the optical cable, wherein the first detonator is coupled to the first perforating gun at an upper portion of the first perforating gun, wherein the second detonator is coupled to the second perforating gun at an upper portion of the second perforating gun.

* * * * *